US006062886A

United States Patent [19]

Chen

[11] Patent Number: 6,062,886

[45] Date of Patent: May 16, 2000

[54] WATERPROOF AC POWER SUPPLY SOCKET

[76] Inventor: Li-Wu Chen, No. 97-1, Chung-Ching Rd., Taichung, Taiwan

[21] Appl. No.: 09/316,788

[22] Filed: May 21, 1999

[51] Int. Cl.[7] ..... H01R 13/703

[52] U.S. Cl. ..... 439/188; 439/592; 200/51.09

[58] Field of Search ..... 439/188, 911, 439/592, 140; 200/51.09

[56] References Cited

U.S. PATENT DOCUMENTS

| | | | |
|---|---|---|---|
| 4,148,536 | 4/1979 | Petropoulsos et al. | 439/188 |
| 4,185,881 | 1/1980 | Foley et al. | 439/188 |
| 4,758,696 | 7/1988 | Grazer | 200/51.09 |
| 5,374,199 | 12/1994 | Chung | 439/188 |
| 5,551,884 | 9/1996 | Burkhart, Sr. | 439/140 |
| 5,876,236 | 3/1999 | Chen | 439/419 |

*Primary Examiner*—Steven L. Stephan
*Assistant Examiner*—Son V. Nguyen
*Attorney, Agent, or Firm*—Limbach & Limbach L.L.P.

[57] ABSTRACT

An AC power supply socket is adapted for receiving an electrical plug and includes a housing having a top opening, a pair of socket terminals disposed in the housing, and a flexible cover mounted on the housing to cover the top opening sealingly. The cover has an insulating plate disposed above the socket terminals, and a pair of conductive hollow legs connected integrally with the insulating plate, aligned with the socket terminals, and adapted to receive a pair of conductive prongs of the plug. The insulating plate has an intermediate portion and two opposite flexible portions. The hollow legs extend downward from the intermediate portion into the housing without contacting the socket terminals in a normal state, and are movable downward further to contact the socket terminals when the insulating plate is flexed downward upon insertion of the plug into the hollow legs.

9 Claims, 4 Drawing Sheets

WATERPROOF AC POWER SUPPLY SOCKET

BACKGROUND OF THE INVENTION

1. Field of the Invention

This invention relates to an AC power supply socket, more particularly to a waterproof AC power supply socket that is capable of preventing water from penetrating into the socket.

2. Description of the Related Art

Typical AC power supply sockets normally include a housing and a pair of slots extending inward from the surface of the housing and adapted for insertion of a pair of conductive prongs of an electrical plug. Such slots are normally open to the outside environment without any shield to prevent water from penetrating into the housing of the socket, thereby rendering the socket vulnerable to the intrusion of water in some circumstances, such as in case of exposure to rain, and may result in short circuit, deterioration, and even current leakage for the socket.

FIG. 1 shows a conventional AC power supply socket that is capable of preventing water from penetrating thereinto. The socket 1 includes a housing 11 with a pair of insertion slots 111, two magnet compartments 13, two terminal compartments 14, and two Teflon plates 12 for isolating the magnet compartments 13 and the terminal compartments 14, respectively. A spring seat 133 is mounted on the bottom of each magnet compartment 13 and has a spring 134 seated thereon. A sliding part 131 is seated on top of each spring 134 so as to be biased upward from a connecting position to a disconnecting position. A slidable magnet 132 adjacent to one side of the Teflon plate 12 is connected to the bottom side of each sliding part 131, and magnetically engages a low carbon steel piece 141 which is disposed inside each terminal compartment 14 adjacent to the other side of the Teflon plate 12. A conductive bridge piece 142 is connected to the bottom of each steel piece 141 for bridging the gap between an upper terminal piece 143 and a lower terminal piece 144 which are disposed on the bottom of the terminal compartment 14. Each lower terminal piece 144 is electrically connected to a conductive element 112 which is adapted for connecting to an electrical wire.

As shown in FIG. 2, the sliding parts 131 are moved downward when the prongs 21 of a plug 2 are inserted into the slots 111 of the socket 1. The magnets 132 move along with the sliding parts 131 and magnetically drive the steel pieces 141 to move downwardly to permit the bridge piece 142 to bridge the gap between the upper terminal piece 143 and the lower terminal piece 144. In contrast, when the prongs 21 of the plug 2 are pulled out from the slots 111 of the socket 1, the sliding parts 131 are moved back to the original positions thereof by the returning force of the springs 134. The slots 111 of the socket 1 are blocked by the sliding parts 131 when the sliding parts 131 are at their normal original state, thereby preventing water from penetrating into the slots 111, and thus into the housing 11 of the socket 1.

The conventional socket 1 described above is capable of preventing water from penetrating into the socket 1. However, the use of the magnetic means and the associated parts of the socket 1 makes the manufacture thereof more complicated and laborious.

SUMMARY OF THE INVENTION

Therefore, it is an object of the present invention to provide an AC power supply socket that is adapted for receiving an electrical plug and that is capable of preventing water from penetrating into the socket.

Accordingly, an AC power supply socket of the present invention comprises: a housing having a top opening, a bottom, and a peripheral side wall extending upward from the bottom to confine a receiving space; a pair of socket terminals disposed on the bottom of the housing within the receiving space; and a watertight flexible cover mounted on the housing to cover the top opening sealingly, the cover having an insulating plate disposed above the socket terminals, and a pair of conductive hollow legs connected integrally with the plate, aligned with the socket terminals, and adapted to receive a pair of conductive prongs of the plug, the hollow legs extending downward from the plate into the receiving space without contacting the socket terminals in a normal state, the hollow legs being movable downward further to contact the socket terminals when the insulating plate is flexed downward upon insertion of the plug into the hollow legs.

BRIEF DESCRIPTION OF THE DRAWINGS

In drawings which illustrate an embodiment of the invention.

DETAILED DESCRIPTION OF THE PREFERRED EMBODIMENT

Figure 1:
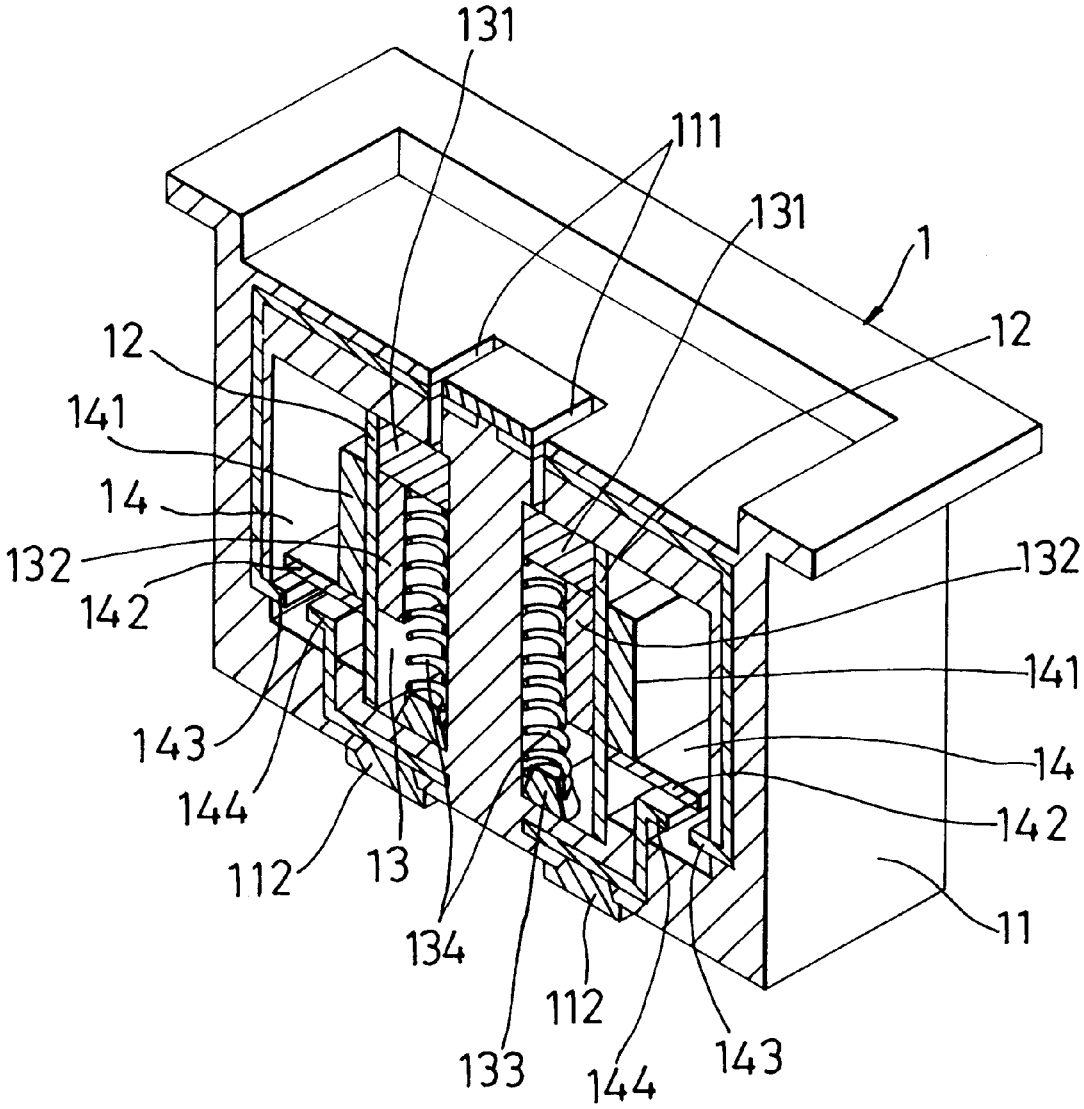
FIG. 1 PRIOR ART
FIG. 1 illustrates a conventional AC power supply socket.
Figure 2:
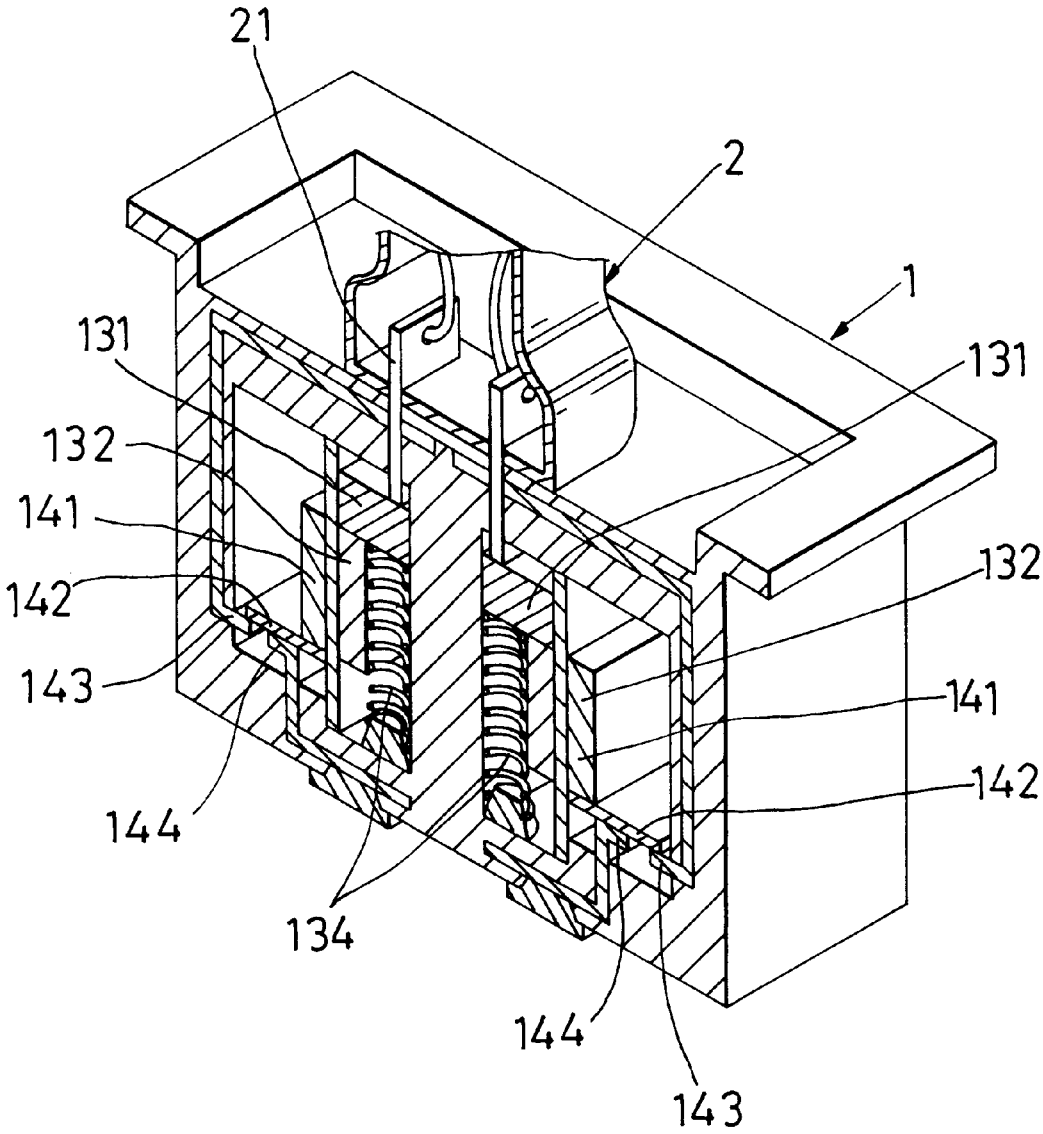
FIG. 2 PRIOR ART
FIG. 2 illustrates the conventional AC power supply socket of FIG. 1 upon mating with a plug.
Figure 3:
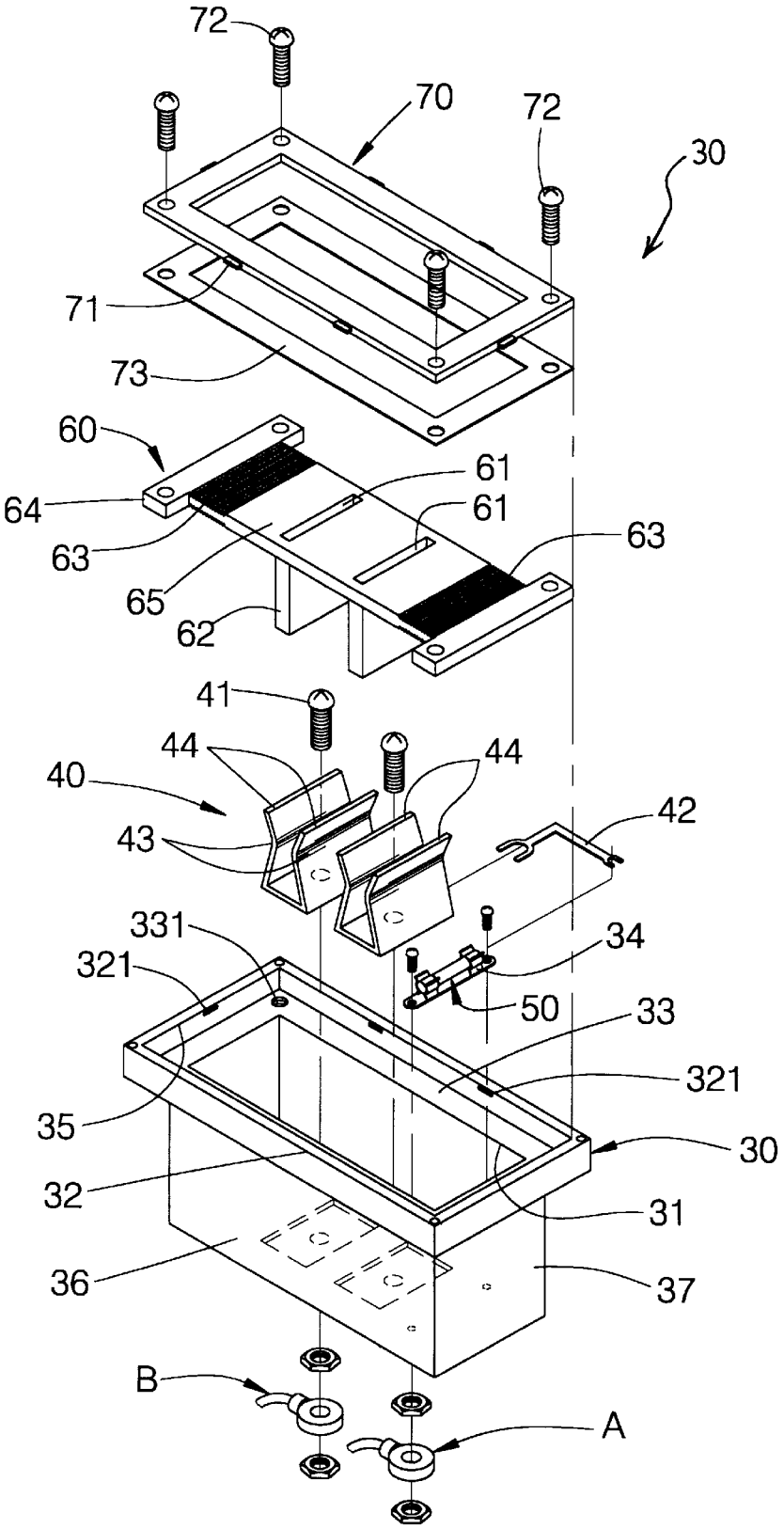
FIG. 3 is an exploded view of an AC power supply socket embodying this invention.
Figure 4:
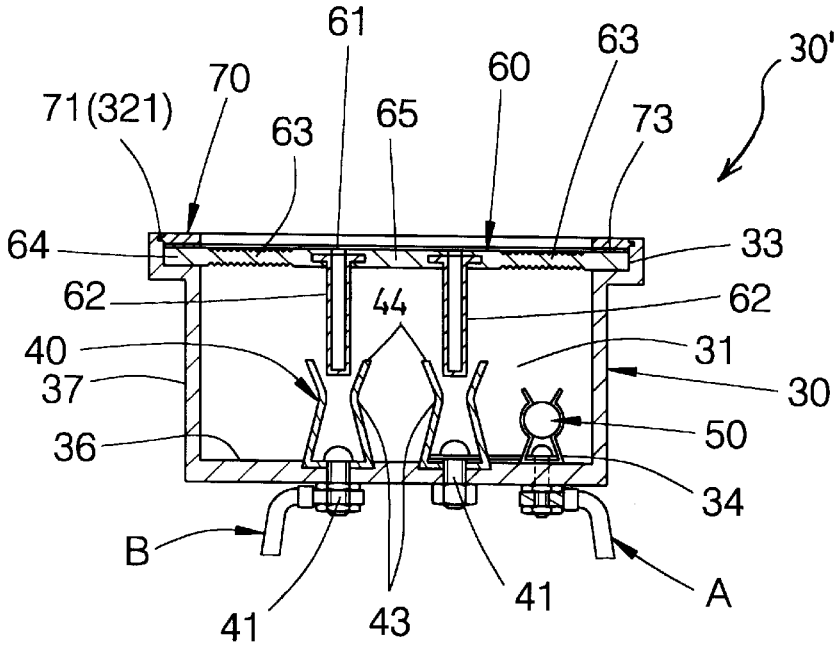
FIG. 4 illustrates a cross-sectional side view of the AC power supply socket of FIG. 3.

FIGS. 3 and 4 illustrate an AC power supply socket 30' embodying the present invention. The socket 30' of this invention includes a housing 30 having a top opening 35, a bottom 36, and a peripheral side wall 37 extending upward from the bottom 36 to confine a receiving space 31, a pair of socket terminals 40 disposed on the bottom 36 of the housing 30, a fuse seat 34 with a fuse 50 mounted thereon, a flexible cover 60 mounted on the housing 30 for covering the top opening 35 of the housing 30, a frame 70 disposed above the cover 60 for positioning the cover 60 on the housing 30, and a plastic frame gasket 73 disposed between the cover 60 and the frame 70.

The housing 30 of the socket 30' is made of plastic material and is rectangular in shape. A peripheral shoulder 33 projects outward from the peripheral side wall 37, and a peripheral rim 32 is raised from the peripheral shoulder 33 to confine the top opening 35 of the housing 30. The peripheral shoulder 33 is provided with a plurality of screw holes 331. The peripheral rim 32 has a plurality of locking recesses 321. At the bottom 36 of the housing 30, one of the two opposite ends of the fuse 50 is electrically connected to an electrical wire (A).

Each socket terminal 40 includes a pair of opposite conductive clamping pieces 44 spaced apart from each other. The clamping pieces 44 have bending portions 43 projecting toward each other to form a constricted space. Each socket terminal 40 is securely screwed on the bottom 36 of the housing 30 by screw means 41. A conductive U-shape connecting piece 42 has two opposite ends connected respectively to the other one of the two opposite ends of the fuse 50 and one of the clamping pieces 44 of the socket terminal 40 adjacent to the fuse 50. The other one of the clamping pieces 44 is connected to an electrical wire (B).

Figure 5:
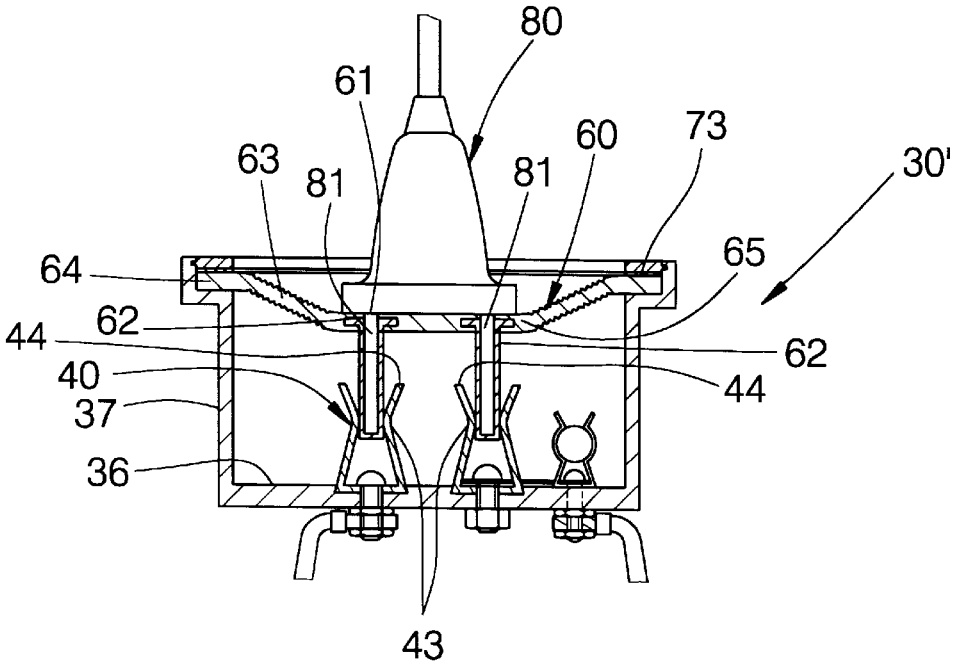
FIG. 5 illustrates a cross-sectional side view of the AC power supply socket of FIG. 3 upon mating with a plug.

The flexible cover 60 includes an insulating plate 64 disposed above the socket terminals 40 and seated on the peripheral shoulder 33 of the housing 30 to close completely the top opening 35, and a pair of conductive hollow legs 62 mounted integrally on the plate 64 and adapted to receive entirely a pair of conductive prongs 81 of an electrical plug 80 (as shown in FIG. 5). The insulating plate 64 has an intermediate portion 65 and two opposite flexible portions 63 spaced apart by the intermediate portion 65, and a pair of slots 61 disposed in the intermediate portion 65 and aligned with the socket terminals 40. The hollow legs 62 are communicated with the slots 61, extend downward from the intermediate portion 65 into the receiving space 31 of the housing 30, and have closed bottom ends to contact the socket terminals 40. The flexible portions 63 of the insulating plate 64 are materially puckered so as to be flexible.

A plurality of locking protrusions are provided on the frame 70 to engage the locking recesses 321 of the peripheral rim 32, and is securely screwed to the cover 60 and to the shoulder 33 of the housing 30 by screw means 72 extending through screw holes 331 of the shoulder 33.

Referring now to FIG. 4, the hollow legs 62 are spaced apart from the socket terminals 40. Since each hollow leg 62 has a closed bottom end, water is prevented from penetrating from the outside into the housing 30 via the slots 61 and the hollow legs 62.

Referring now to FIG. 5, the hollow legs 62 are moved downward to a connecting position in which they contact the socket terminals 40, and are clamped between the two opposite clamping pieces 44 of the socket terminals 40 at the bending portions 43 of the clamping pieces 44 to form a closed electric circuit when the insulating plate 64 is flexed downward upon insertion of a pair of prongs 81 of an electrical plug 80. The hollow legs 62 are moved back to a disconnecting position to disconnect from the socket terminals 40 when the insulating plate 64 returns to its original position upon withdrawing the prongs 81 of the plug 80 from the socket 30'.

With the invention thus explained, it is apparent that various modifications and variations can be made without departing from the spirit of the present invention. It is therefore intended that the invention be limited only as recited in the appended claims.

I claim:

1. An AC power supply socket adapted for receiving an electrical plug, comprising:

a housing having a top opening, a bottom, and a peripheral side wall extending upward from said bottom to confine a receiving space;

a pair of socket terminals disposed on said bottom of said housing within said receiving space; and a watertight flexible cover mounted on said housing to cover said top opening sealingly, said cover having an insulating plate disposed above said socket terminals, and a pair of conductive hollow legs connected integrally with said plate, aligned with said socket terminals, and adapted to receive a pair of conductive prongs of the plug, said hollow legs extending downward from said insulating plate into said receiving space without contacting said socket terminals in a normal state, said hollow legs being movable downward further to contact said socket terminals when said insulating plate is elastically flexed downward upon insertion of the plug into said hollow legs.

2. The AC power supply socket as claimed in claim 1, wherein said insulating plate has an intermediate portion and two opposite flexible portions spaced apart by said intermediate portion.

3. The AC power supply socket as claimed in claim 1, further comprising a frame mounted on said cover for positioning said cover on said housing.

4. The AC power supply socket as claimed in claim 1, further comprising a fuse disposed inside said receiving space and electrically connected to one of said socket terminals.

5. The AC power supply socket as claimed in claim 4, further comprising a fuse seat disposed on said bottom of said housing for mounting said fuse thereon.

6. The AC power supply socket as claimed in claim 2, wherein each of said flexible portions is puckered so as to be flexible.

7. The AC power supply socket as claimed in claim 1, wherein each of said socket terminals includes a pair of opposite clamping pieces spaced apart from each other, said clamping pieces having bending portions projecting toward each other so as to clamp the corresponding one of said hollow legs.

8. The AC power supply socket as claimed in claim 1, wherein said housing further includes a peripheral shoulder projecting outward from said peripheral side wall and a peripheral rim raised from said peripheral shoulder to confine said top opening, said peripheral rim having a plurality of locking recesses disposed thereon, said frame having a plurality of locking protrusions disposed thereon to engage said locking recesses, said insulating plate being seated on said shoulder, said plate and said frame being screwed to said shoulder.

9. The AC power supply socket as claimed in claim 1, wherein each of said hollow legs has a closed bottom end to contact one of said socket terminals.

* * * * *